United States Patent [19]

Hettinger, Jr. et al.

[11] Patent Number: 4,552,647

[45] Date of Patent: Nov. 12, 1985

[54] PROCESS FOR CRACKING HIGH-BOILING HYDROCARBONS USING CONTINUOUS ADDITION OF ACIDITY ENHANCING ADDITIVES

[75] Inventors: William P. Hettinger, Jr., Russell; Stephen M. Kovach, Ashland; Hubert W. Beck, Russell, all of Ky.

[73] Assignee: Ashland Oil, Inc., Ashland, Ky.

[21] Appl. No.: 600,747

[22] Filed: Apr. 18, 1984

Related U.S. Application Data

[60] Division of Ser. No. 474,619, Mar. 11, 1983, Pat. No. 4,496,665, which is a continuation-in-part of Ser. No. 277,751, Mar. 30, 1981, Pat. No. 4,432,890.

[51] Int. Cl.[4] ..... C10G 11/18

[52] U.S. Cl. ..... 208/120; 208/52 CT; 502/521

[58] Field of Search ..... 208/120, 56 CT; 502/521, 20, 29

[56] References Cited

U.S. PATENT DOCUMENTS

| | | | |
|---|---|---|---|
| 2,886,513 | 5/1959 | Baker | 502/304 |
| 2,901,419 | 8/1959 | Brill | 502/25 |
| 3,234,119 | 2/1966 | Erickson et al. | 502/241 |
| 3,264,227 | 8/1966 | Cramer et al. | 208/120 |
| 3,354,078 | 11/1967 | Miale et al. | 208/120 |
| 3,696,025 | 10/1972 | Chesmore | 208/113 |
| 4,289,608 | 9/1981 | McArthur | 208/120 |
| 4,299,688 | 11/1981 | Tu et al. | 208/120 |
| 4,313,799 | 3/1982 | Yoo | 208/120 |
| 4,317,713 | 3/1982 | Burk, Jr. et al. | 208/120 |
| 4,333,821 | 6/1982 | Tu | 208/120 |
| 4,337,144 | 6/1982 | Yoo | 208/120 |
| 4,363,717 | 12/1982 | Pelrine et al. | 208/116 |
| 4,367,164 | 1/1983 | Shiroto | 252/457 |
| 4,421,637 | 12/1983 | Grenoble et al. | 208/120 |
| 4,425,259 | 1/1984 | Hettinger et al. | 208/120 |
| 4,454,025 | 6/1984 | Hettinger, Jr. | 208/120 |
| 4,477,335 | 10/1984 | Benslay | 208/161 |
| 4,496,665 | 1/1985 | Hettinger et al. | 502/29 |

*Primary Examiner*—D. E. Gantz
*Assistant Examiner*—Anthony McFarlane
*Attorney, Agent, or Firm*—Richard C. Willson, Jr.; Stanley M. Welsh

[57] ABSTRACT

A process for economically converting carbo-metallic oils to lighter products. The carbo-metallic oils contain 650° F.+ material which is characterized by containing material which will not boil below about 1025° F., a carbon residue on pyrolysis of at least about 2, and a nickel plus vanadium content of at least about 4 parts per million. This process comprises adding an additive to the feedstock consisting of a compound containing titanium, zirconium, or aluminum so as to restore cracking activity of high metal contaminated and deactivated, zeolite containing catalysts, resulting from processing of these carbo-metallic oils.

20 Claims, 1 Drawing Figure

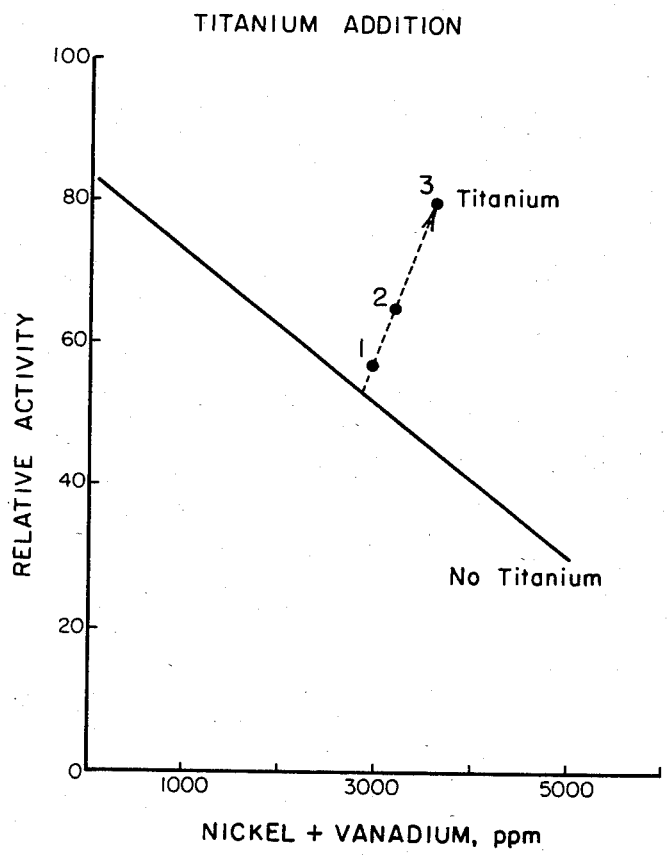
TITANIUM ADDITION
100
80
60
40
20
0
RELATIVE ACTIVITY
3
Titanium
2
1
No Titanium
1000
3000
5000
NICKEL + VANADIUM, ppm

PROCESS FOR CRACKING HIGH-BOILING HYDROCARBONS USING CONTINUOUS ADDITION OF ACIDITY ENHANCING ADDITIVES

CROSS REFERENCES TO RELATED APPLICATIONS

This application is a division of application Ser. No. 474,619 filed Mar. 11, 83, now U.S. Pat. No. 4,496,665, which is a continuation-in-part of U.S. Ser. No. 06/277,751 filed 3/30/81, now U.S. Pat. No. 4,432,890.

The present invention relates to the general field of the following patent applications: U.S. Ser. No. 06/277,752, filed 3/19/81; U.S. Ser. No. 06/277,751, filed 3/30/81; U.S. Ser. No. 06/263,395, filed 5/13/81; U.S. Ser. No. 06/443,413, filed 11/22/82.

TECHNICAL FIELD

This invention relates to processes for converting heavy hydrocarbon oils into lighter fractions, and especially to processes for converting heavy hydrocarbons containing high concentrations of coke precursors and heavy metals into gasoline and other liquid hydrocarbon fuels. More particularly, this invention relates to processes for dealkylating and cracking heavy high boiling hydrocarbons.

PRIOR ART

In general, gasoline and other liquid hydrocarbon fuels boil in the range of about 100° to about 650° F. However, the crude oil from which these fuels are made contains a diverse mixture of hydrocarbons and other compounds which vary widely in molecular weight and therefore boil over a wide range. For example, crude oils are known in which 30 to 60% or more of the total volume of oil is composed of compounds boiling at temperatures above 650° F. Among these are crudes in which about 10% to about 30% or more of the total volume consists of compounds so heavy in molecular weight that they boil above 1025° F. or at least will not boil below 1025° F. at atmospheric pressure.

Because these relatively abundant high boiling components of crude oil are unsuitable for inclusion in gasoline and other liquid hydrocarbon fuels, the petroleum refining industry has developed processes for cracking or breaking the molecules of the high molecular weight, high boiling compounds into smaller molecules which do boil over an appropriate boiling range. The cracking process which is most widely used for this purpose is known as fluid catalytic cracking (FCC). Although the FCC process has reached a highly advanced state, and many modified forms and variations have been developed, their unifying factor is that a vaporized hydrocarbon feedstock is caused to crack at an elevated temperature in contact with a cracking catalyst that is suspended in the feedstock vapors. Upon attainment of the desired degree of molecular weight and boiling point reduction, the catalyst is separated from the desired products.

Crude oil in the natural state contains a variety of materials which tend to have quite troublesome effects on FCC processes, and only a portion of these troublesome materials can be economically removed from the crude oil. Among these troublesome materials are coke precursors (such as asphaltenes, polynuclear aromatics, etc.), heavy metals (such as nickel, vanadium, iron, copper, etc.), alkaline metals (such as sodium, potassium, etc.), sulfur, nitrogen and others. Certain of these, such as the alkaline metals, can be economically removed by desalting operations, which are part of the normal procedure for pretreating crude oil for fluid catalytic cracking. Other materials, such as coke precursors, asphaltenes and the like, tend to break down into coke during the cracking operation, which coke deposits on the catalyst, impairing contact between the hydrocarbon feedstock and the catalyst, and generally reducing its potency or activity level. The heavy metals transfer almost quantitatively from the feedstock to the catalyst surface.

As the catalyst is reused again and again for processing additional feedstock, which is usually the case, the heavy metals can accumulate on the catalyst to the point that they unfavorably alter the composition of the catalyst and/or nature of its effect upon the feedstock. For example, vanadium tends to form fluxes with certain components of commonly used FCC catalysts, lowering the melting point of portions of the catalyst particles sufficiently so that they begin to sinter and become ineffective cracking catalysts. Accumulations of vanadium and other heavy metals, especially nickel, also "poison" the catalyst. They tend in varying degrees to promote excessive dehydrogenation and aromatic condensation, resulting in excessive production of carbon and gases with consequent impairment of liquid fuel yield. An oil such as a crude or crude fraction or other oil that is particularly abundant in nickel and/or other metals exhibiting similar behavior, while containing relatively large quantities of coke precursors, is referred to herein as a carbo-metallic oil, and represents a particular challenge to the petroleum refiner.

Several proposals have been considered involving treating the heavy oil feed to remove the metal therefrom prior to cracking, such as by hydrotreating, solvent extraction and complexing with Friedel-Crafts catalysts, but these techniques have been criticized as unjustified economically. Another proposal employs a combination cracking process having "dirty oil" and "clean oil" units. Still another proposal blends residual oil with gas oil and controls the quantity of residual oil in the mixture in relation to the equilibrium flash vaporization temperature at the bottom of the riser type cracker unit employed in the process. Still another proposal subjects the feed to a mild preliminary hydrocracking or hydrotreating operation before it is introduced into the cracking unit. It has been suggested to contact a carbo-metallic oil such as reduced crude with hot taconite pellets to produce gasoline. This is a small sampling of the many proposals which have appeared in the patent literature and technical papers.

Notwithstanding the great effort which has been expended and the fact that each of these proposals overcomes some of the difficulties involved, conventional FCC practice today bears mute testimony to the dearth of carbo-metallic oil-cracking techniques that are both economical and highly practical in terms of technical feasibility. Some crude oils are relatively free of coke precursors or heavy metals or both, and the troublesome components of crude oil are for the most part concentrated in the highest boiling fractions. Accordingly, it has been possible to largely avoid the problems of coke precursors and heavy metals by sacrificing the liquid fuel yield which would be potentially available from the highest boiling fractions. More particularly, conventional FCC practice has employed as feedstock that fraction of crude oil which boils at about 650° F. to about 1,000° F., such fractions being relatively free of coke precursors and heavy metal contamination. Such feedstock, known as "vacuum gas oil" (VGO) is generally prepared from crude oil by distilling off the fractions boiling below about 650° F. at atmospheric pressure and then separating by further vacuum distillation from the heavier fractions a cut boiling between about 650° F. and about 1025° F.

The vacuum gas oil is used as feedstock for conventional FCC processing. The heavier fractions are normally employed for a variety of other purposes, such as for instance production of asphalt, residual fuel oil, #6 fuel oil, or marine Bunker C fuel oil, which represents a great waste of the potential value of this portion of the crude oil, especially in light of the great effort and expense which the art has been willing to expend in the attempt to produce generally similar materials from coal and shale oils. The present invention is aimed at the simultaneous cracking of these heavier fractions containing substantial quantities of both coke precursors and heavy metals, and possibly other troublesome components, in conjunction with the lighter oils, thereby increasing the overall yield of gasoline and other hydrocarbon liquid fuels from a given quantity of crude. As indicated above, the present invention by no means constitutes the first attempt to develop such a process, but the longstanding recognition of the desirability of cracking carbo-metallic feedstocks, along with the slow progress of the industry toward doing so, show the continuing need for such a process. It is believed that the present process is uniquely advantageous for dealing with the problem of treating such carbo-metallic oils in an economically and technically sound manner.

One method of cracking these high boiling fractions, named Reduced Coke Conversion (RCC) after a particularly common and useful carbo-metallic feed, is disclosed in U.S. Pat. No. 4,332,673 (Docket 6049EUS) and U.S. Pat. No. 4,341,624 (Docket 6049AUS) each filed Nov. 14, 1979, for "Carbo-Metallic Oil Conversion" and each being incorporated herein by reference. The oils disclosed as capable of being cracked by the methods of these applications are carbo-metallic oils of which at least about 70 percent boils above 650° F. and which contain a carbon residue on pyrolysis of at least about 1 and at least about 4 parts per million of nickel equivalents of heavy metals. Examples of these oils are crude oils, topped crudes, reduced crudes, residua, and extracts from solvent deasphalting.

The cracking reaction for the method disclosed in application Ser. No. 94,216 (Docket 6049AUS) is sufficiently severe to convert 50% or more of the feedstock to gasoline per pass and produce coke in the amount of 6 to 14% by weight based on weight of fresh feed. In a typical RCC cracking process the ratio of weight of catalyst to weight of feedstock is from about 3 to about 18, coke is laid down on the catalyst in amounts in the range of about 0.3 to about 3 percent by weight based on the weight of the catalyst, and heavy metals accumulate on the catalyst to a concentration of from about 3000 to about 30,000 ppm nickel equivalents.

During the cracking process, the heavy metal inventory of the feed transfers almost quantitatively from the feedstock oil to the catalyst particles. These heavy metals tend to deposit near the surface of the catalyst matrix of each particle where they can readily catalyze undesirable dehydrogenation and methyl clipping reactions. It is to be understood, however, that a significant proportion of these metals may also deposit on interior surfaces of the catalyst matrix where they can also cause such undesirable cracking reactions.

For purposes of this application, the term "heavy metals" refers to nickel, vanadium, copper and iron, although trace amounts of other heavy metal elements may sometimes be present. The total amount of heavy metals in the feed is comprised principally of nickel and vanadium (90 or more weight percent based on total heavy metals). The undesirable dehydrogenation and methyl clipping reactions catalyzed by these metals form hydrogen and methane gases and increase the amount of coke deposited on the catalyst. The formation of increasing amounts of hydrogen and methane as heavy metals build up on the catalyst increases the amount of gaseous material and that must be handled by refinery gas treating and compression equipment and decreases catalyst selectivity for gasoline production, i.e., the volume percent yield of gasoline boiling range products is reduced. Vanadium, and to a lesser extent nickel, may also migrate to and poison the catalytic acid sites of the catalyst. Poisoning of the acid sites decreases the level of conversion and may thereby also decrease the yield of gasoline boiling range products, as well as the heavier cycle oil products.

BACKGROUND OF THE INVENTION

As pointed out, what is generally sought in providing a catalyst which will operate in a preferred manner when processing residual containing feedstocks, is a catalyst containing acidity in the matrix. Generally speaking, we prefer a catalyst matrix which possesses an acidity of greater than 0.1 meg/gm of acidity as measured by tridodecyl amine acidity titration. The reason for this is that it is desired to partially crack large molecules, generally too large to enter a zeolite cage, and a number of approaches to this problem have been proposed including the incorporation of acidic matrices such as silica-alumina, silica-titania, silica-zirconia, and combinations thereof as well as montmorillonite, or acid treated bentonite, mordenite and synthetic montmorillonite, to name a few. However, in all cases with regard to matrix acidity, it is accepted that these sites will gradually be neutralized by the metal contaminants of nickel, vanadium, and sodium. What is sought is a site that is not poisoned by any of these materials or resists poisoning. In the past, a stabilizing material was sought, but it is doubted whether any such material can be found.

SUMMARY OF THE INVENTION

This invention involves continuous addition of a titanium, aluminum or a zirconium additive to a cracking catalyst employed in conversion of residual stocks, so as to continuously regenerate new acid sites in the matrix, in order to promote matrix cracking of large molecules, not susceptible to cracking by zeolites. These additives serve to restore activity in the presence of large concentrations of contaminating metal deposited on the catalyst, which metals normally destroy conversion activity and degrade catalyst selectivity.

In the process of exploring and seeking to devise means for maintaining and/or restoring acidity in the matrix, we have evaluated many possible approaches. As previously discussed, it was found desirable, without being bound by theory, to create a matrix which could, through catalytic cracking, reduce the size and shape of molecules too large to enter a zeolite pore so as to permit entry to the zeolite for further cracking so as to simply reduce these large molecules to gasoline directly, as previously accomplished in earlier non-zeolite containing catalysts employed by the industry prior to the introduction of zeolites.

It was also found desirable to utilize this acidic matrix to convert molecules boiling above 650° F., which molecules are of low economic value, to lower boiling molecules either in the gasoline range or, when in higher demand, to heating oil, diesel fuel or the like, in which case it was again found that a catalyst with an acidic matrix was preferred.

We have now found that a method for achieving the above objectives can be obtained in a new and unique manner by the continuous additon of an acid generating additive. More specifically, we have found that the continuous addition of a titanium, zirconium, or aluminum bearing additive to the feedstock, or the catalyst, in a process operating on these metal and carbonaceous generating feedstocks, acts to slow down loss of activity and selectivity and can actually function so as to maintain and even restore activity and selectivity.

What results then is the continuous generation of acidity in situ during contaminant neutralization of the catlyst, thereby further extending and enhancing the stability of the catalyst and also providing a matrix acidity which is desired and which enhances selectivity as well.

EXAMPLES I-II

Fresh feed comprising vacuum gas oil and resid was charged to a commercial FCC unit. Total feed consisted of 16,000 B/D of vacuum gas oil containing 1 ppm vanadium and 2,000 B/D of resid containing 100 ppm vanadium. The combined blend contained 14.6 ppm vanadium. To the feed was added 490 lbs. of isopropyl titanate per day which corresponds to a 1:1 mole ratio of Ti to V. FIG. I shows the results obtained in processing this feed before (Example I) and during (Example II) titanium addition. The black squares numbered 1, 2 and 3 represent each individual week during titanium addition. The time period before titanium addition is represented by the curve during the period 0 to 2000 ppm V on catalyst. It will be noted that catalyst activity was decreasing during vanadium build up from 0–2000 ppm. When titanium was added, catalyst activity increased with each week up to 3 weeks.

To further verify the effect of titanium addition on increasing catalyst activity, the acidity of the regenerated catalyst was measured before and during titanium addition. One week prior to titanium addition, the acidity of the catalyst was measured by n-butylamine titration and shown to have an acidity factor of 0.35 meq/gm. In the second week (#2 square) the acidity of the regenerated catalyst was measured at 0.38 meq/gm. This acidity titration shows the catalyst acidity increased instead of showing a decrease, since the fresh steamed catalyst prior to use has an acidity factor of 0.61 meq/gm.

Examination of yields after two weeks of injecting tetra isopropyl titanate also shows that gasoline yield also increased. The results of two runs before and after titanium addition are shown in Table I.

TABLE I

| | Example I (Conventional) Before Titanium Addition | Example II (Invention) 2 Weeks Later Addition of Titanium equal to 1/1 Ti/V |
|---|---|---|
| Nickel ppm | 1400 | 1600 |
| Vanadium ppm | 1900 | 2200 |
| Titanium ppm | 9900 | 16,300 |
| Total FCC Charge BPD | 18,190 | 19,270 |
| C5 - 430° F. Vol. % | 48.9 | 52.6 |
| Coke Wt. % | 6.5 | 6.0 |
| Volume Gain | 15.8 | 16.5 |
| Conversion Vol. % | 70.8 | 70.9 |
| Gasoline Selectivity | 69.1 | 74.2 |

MODIFICATIONS

It will be understood by those skilled on the art that the invention is not to be limited by the above example and that the discription is susceptible to a number of modifications without departing from the scope of the invention. The above mentioned references and literature cited therein are hereby incorporated by reference.

What is claimed is:

1. A process for converting residual hydrocarbon stocks including, reduced crude and the like, containing greater than 4 ppm of nickel plus vanadium and 2% Conradson Carbon, said process utilizing a zeolite-containing catalyst comprising at least about 2000 ppm of Ni+V contaminants, said process comprising continuous addition to said feed stock or catalyst an additive comprising Ti, Zr or mixtures thereof, so as to maintain conversion activity and selectivity in the presence of said contaminating metals.

2. Said process as described in claim 1 in which the additive is added at the rate of two times the concentration of nickel and vanadium used in the feedstock.

3. A process as described in claim 1 in which the additive used to enhance activity is added at a rate greater than 2 ppm on feedstock.

4. A process of claim 1 in which the additive is an organic titanium compound.

5. A process as described in claim 1 in which the additive is added in sufficient quantity so as to bring the concentration of additive to greater than 1,000 ppm on the catalyst.

6. A process as described in claim 1 in which the zirconium compound is an organic compound of zirconium.

7. A process as described in claim 1 in which the additive and hydrocarbon feedstock are combined prior to introduction into the reactor.

8. A process according to claim 1 in which the additive is a titanium compound.

9. A process for converting a carbo-metallic feedstock containing greater than 10 ppm of Ni+V-+Fe+Na and greater than 4% Conradson Carbon when operating on a catalyst containing more than 3,000 ppm of Ni+V and incremental Na and wherein the feedstock contains greater than 200 ppm of basic nitrogen and in which the catalyst is a zeolite containing catalyst, consisting of adding continuously to the feedstock an additive comprising Ti, or Zr, which additive is able to continuously renew and restore cracking activity in the presence of metals shown to be destructive of activity and selectivity.

10. A process according to claim 9 in which the additive is a titanium containing compound.

11. A process according to claim 9 in which the additive is a zirconium containing compound.

12. A process according to claim 9 in which the amount of additive added to the catalyst is maintained at a level greater than 500 ppm on the catalyst.

13. A process according to claim 1 or 9 in which the additive is tetra isopropyl titanate.

14. A process according to claim 1 or 9 in which the titanium compound is dissolved in a hydrocarbon solvent and added to the hydrocarbon feedstock so as to facilitate handling and prevent hydrolysis.

15. A process according to claim 1 or 9 in which the cracking catalyst contains more than 50% silica.

16. A process according to claim 1 or 9 in which the catalyst is one designed to process residual feedstocks.

17. A process according to claim 1 or 9 in which the catalyst possess a matrix acidity.

18. A process according to claim 1 or 9 in which the matrix is predominantly a silica based matrix.

19. A process for converting a carbo-metallic feedstock containing greater than 10 ppm of Ni+V+Fe+Na and greater than 4% Conradson Carbon when operating on a catalyst containing more than 3,000 ppm of Ni+V and incremental Na and wherein the feedstock contains greater than 200 ppm of basic nitrogen and in which the catalyst is a zeolite containing catalyst, consisting of adding continuously to the regenerator an additive, wherein the additive is an organic or inorganic material selected from the group consisting of Ti or Zr containing material, which is able to continuously renew and restore cracking activity in the presence of metals shown to be destructive of activity and selectivity.

20. A process according to claim 19 in which the additive is tetra isopropyl titanate.

* * * * *